US011098439B2

(12) United States Patent
Yoon et al.

(10) Patent No.: US 11,098,439 B2
(45) Date of Patent: Aug. 24, 2021

(54) LAUNDRY TREATMENT APPARATUS

(71) Applicant: LG ELECTRONICS INC., Seoul (KR)

(72) Inventors: Taejun Yoon, Seoul (KR); Sunyong Kim, Seoul (KR); Hyoungsup Park, Seoul (KR); Junyoung Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 167 days.

(21) Appl. No.: 16/546,730

(22) Filed: Aug. 21, 2019

(65) Prior Publication Data

US 2019/0376226 A1 Dec. 12, 2019

Related U.S. Application Data

(63) Continuation of application No. 15/809,119, filed on Nov. 10, 2017, now Pat. No. 10,563,345.

(30) Foreign Application Priority Data

Nov. 11, 2016 (KR) ..... 10-2016-0150162

(51) Int. Cl.
*D06F 71/36* (2006.01)
*D06F 71/02* (2006.01)
(Continued)

(52) U.S. Cl.
CPC ..... *D06F 71/36* (2013.01); *D06F 71/02* (2013.01); *D06F 71/34* (2013.01); *D06F 71/40* (2013.01); *D06F 58/10* (2013.01); *D06F 73/02* (2013.01)

(58) Field of Classification Search
CPC .... D06F 71/00–40; D06F 58/10; D06F 73/00; D06F 73/02
See application file for complete search history.

(56) References Cited

U.S. PATENT DOCUMENTS 1,251,402 A 12/1917 Miller et al.
1,325,308 A 12/1919 Riddle
(Continued)

FOREIGN PATENT DOCUMENTS

CN 104294529 A 1/2015
CN 104805634 A 7/2015
(Continued)

OTHER PUBLICATIONS

U.S. Appl. No. 15/809,119, filed Nov. 10, 2017.
U.S. Appl. No. 15/809,119, filed Nov. 10, 2017 (U.S. Pat. No. 10,563,345).

*Primary Examiner* — Ismael Izaguirre
(74) *Attorney, Agent, or Firm* — Dentons US LLP

(57) ABSTRACT

A laundry treatment apparatus is disclosed. The laundry treatment apparatus includes a cabinet having an accommodation space formed therein to accommodate laundry, a laundry support member provided in the accommodation space, and a presser mounted to the laundry support member and configured to apply pressure to laundry to remove wrinkles from laundry. The presser includes a support part for supporting one surface of laundry, a hanger hook configured to be hung on the laundry support member, and a press part hingedly connected to the support part to apply pressure to the opposite surface of laundry.

17 Claims, 10 Drawing Sheets

(51) Int. Cl.

| | |
|---|---|
| ***D06F 71/34*** | (2006.01) |
| ***D06F 71/40*** | (2006.01) |
| *D06F 58/10* | (2006.01) |
| *D06F 73/02* | (2006.01) |

(56) References Cited

U.S. PATENT DOCUMENTS

| | | | | |
|---|---|---|---|---|
| 3,290,807 | A | 12/1966 | Esaka | |
| 4,611,419 | A * | 9/1986 | Duplessy | A47G 25/72 38/21 |
| 5,305,484 | A | 4/1994 | Fitzpatrick et al. | |
| 5,815,961 | A | 10/1998 | Estes et al. | |
| 7,305,856 | B2 * | 12/2007 | Bolduan | D06F 17/04 68/50 |
| 2010/0282785 | A1 * | 11/2010 | Roselle | D06F 58/203 223/61 |
| 2012/0018461 | A1 * | 1/2012 | Azizian | D06F 73/02 223/66 |
| 2015/0020419 | A1 | 1/2015 | Park et al. | |
| 2015/0159315 | A1 | 6/2015 | Lim et al. | |
| 2016/0208429 | A1 | 7/2016 | Park et al. | |

FOREIGN PATENT DOCUMENTS

| | | | |
|---|---|---|---|
| EP | 2826911 | A1 | 1/2015 |
| JP | 0568795 | A | 3/1993 |
| JP | 10-314500 | A | 12/1998 |
| JP | 2000-300896 | A | 10/2000 |
| KR | 10-2010-0022798 | A | 3/2010 |
| KR | 1020120091799 | A | 8/2012 |
| WO | 9402057 | A1 | 2/1994 |
| WO | 2010126926 | A2 | 11/2010 |

* cited by examiner

LAUNDRY TREATMENT APPARATUS

This application is a continuation of U.S. application Ser. No. 15/809,119, filed Nov. 10, 2017, which claims priority and the benefit of Korean Patent Application No. 10-2016-0150162, filed on Nov. 11, 2016, each of which are hereby incorporated herein by reference in their entirety.

BACKGROUND OF THE INVENTION

Field of the Invention

The present invention relates to a laundry treatment apparatus.

Discussion of the Related Art

Generally, laundry treatment apparatuses refer to apparatuses that perform a variety of operations related to laundry (washing, drying, deodorization, wrinkle removal, and the like). Examples of laundry treatment apparatuses include washing machines that wash, rinse and dry laundry, drying machines that dry wet laundry, and refreshers for deodorization of, and removal of wrinkles from, laundry.

Conventional laundry treatment apparatuses include a drum, in which laundry is received, and perform washing, drying and refreshing through rotation of the drum. However, such conventional laundry treatment apparatuses are problematic in that a user cannot wear the laundry immediately after taking the same out of the drum due to wrinkles, in that frequent washing using wash water causes damage to the laundry, and in that energy consumption is high due to the operation of a motor for rotating the drum.

In order to solve the above problems, laundry treatment apparatuses, from which a tub for storing wash water or a rotary drum is removed and which performs washing, drying and refreshing by supplying steam or hot air to laundry hung on a hanger, have been developed. Laundry treatment apparatuses may include a presser for putting a crease in laundry or removing wrinkles from laundry.

However, conventional laundry treatment apparatuses are configured such that a presser is fixedly mounted to a door, making it impossible to move the position of the presser.

SUMMARY OF THE INVENTION

Accordingly, the present invention is directed to a laundry treatment apparatus that substantially obviates one or more problems due to limitations and disadvantages of the related art.

An object of the present invention is to provide a laundry treatment apparatus, which is capable of performing washing, drying, deodorization, sterilization and wrinkle removal of laundry.

Another object of the present invention is to provide a laundry treatment apparatus, which removes wrinkles from laundry and applies pressure to laundry so as to sharpen a crease formed in the laundry.

A further object of the present invention is to provide a laundry treatment apparatus, which includes a presser that is removably mounted thereto so that the position of the presser may be moved.

A further object of the present invention is to provide a laundry treatment apparatus, which includes a presser that is greatly reduced in thickness so that the position of the presser may be efficiently moved in the inner space in the laundry treatment apparatus.

A further object of the present invention is to provide a laundry treatment apparatus, which includes a presser that is removably mounted to a laundry support member.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the object and other advantages and in accordance with the purpose of the invention, as embodied and broadly described herein, a laundry treatment apparatus includes a cabinet having an accommodation space formed therein to accommodate laundry, a laundry support member provided in the accommodation space, and a presser mounted to the laundry support member and configured to apply pressure to laundry to remove wrinkles from laundry, wherein the presser includes a support part for supporting one surface of laundry, a hanger hook configured to be hung on the laundry support member, and a press part hingedly connected to the support part to apply pressure to the opposite surface of laundry.

The hanger hook may be provided at an extension portion, integrally formed at the support part, and may extend upwards from the support part.

The laundry treatment apparatus may further include a laundry-fixing member for fixing laundry to the presser.

The laundry treatment apparatus may further include a separation frame provided at the presser to form a gap between the presser and an inner surface of the accommodation space.

The laundry treatment apparatus may further include a hinge structure for connecting the support part and the press part, and the hinge structure may include a hinge shaft extending in the height direction of the presser, a hinge support portion protruding a predetermined length from the press part, a first hinge hole formed in the hinge support portion so as to allow one end portion of the hinge shaft to be inserted thereinto, a hinge insertion portion concavely formed with a predetermined length in the support part so as to allow the hinge support portion to be inserted thereinto, and a second hinge hole formed in the hinge insertion portion so as to allow the opposite end portion of the hinge shaft to be inserted thereinto.

The hinge structure may further include a hinge bracket having therein the second hinge hole and a bracket seat portion formed in the support part so as to allow the hinge bracket to be seated therein.

The hinge bracket may have therein a bracket-fixing hole, the bracket-fixing hole may communicate with a bracket through-hole formed in the support part, and a bracket-fixing member may be fastened to the support part through the bracket through-hole and the bracket-fixing hole so that the hinge bracket is secured to the bracket seat portion.

The laundry treatment apparatus may further include a locking structure for locking a free end of the press part to the support part, and the locking structure may include a locking hinge shaft extending in the height direction of the presser, a locking body having therein a first locking hinge hole for receiving one end portion of the locking hinge shaft inserted thereinto, the locking body being configured to rotate relative to the support part, a locking extension portion extending from the locking body toward the press part and configured to be locked to the press part, a locking insertion portion concavely formed in the support part so as to allow the locking body to be inserted thereinto, and a second locking hinge hole formed in the locking insertion portion so as to allow the opposite end portion of the locking hinge shaft to be inserted thereinto.

The locking structure may further include a locking bracket having therein the second locking hinge hole and a locking bracket seat portion formed in the support part so as to allow the locking bracket to be seated therein.

The locking bracket may have therein a locking-bracket-fixing hole, the locking-bracket-fixing hole may communicate with a locking-bracket through-hole formed in the support part, and a fixing member may be fastened to the support part through the locking-bracket-fixing hole and the locking-bracket through-hole so that the locking bracket is secured to the locking bracket seat portion.

The locking extension portion may include a first locking protrusion and a second locking protrusion protruding toward the press part so as to be fitted into a locking recess formed in the press part.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
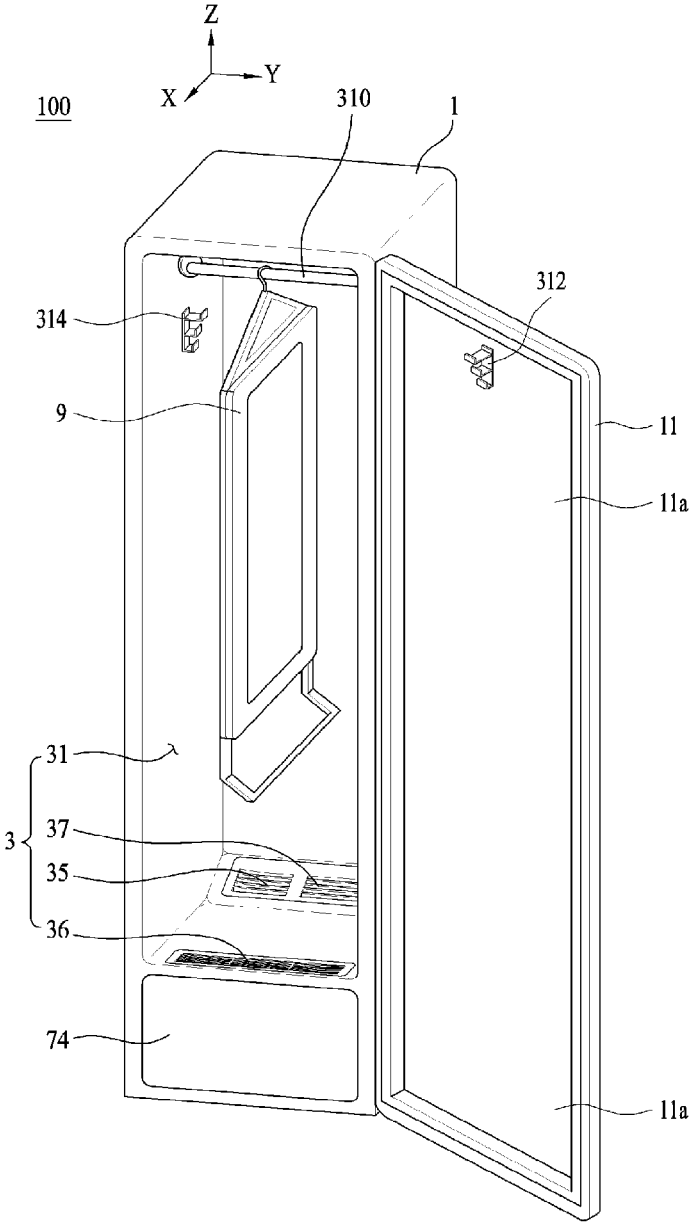
FIG. 1 is a view illustrating a laundry treatment apparatus according to an embodiment of the present invention.

Hereinafter, exemplary embodiments of the present invention will be described in detail with reference to the accompanying drawings. Meanwhile, the configuration of an apparatus or a control method of the apparatus, which will be described below, is merely given to describe the embodiments of the present invention, and is not intended to limit the scope of the present invention. The same reference numerals used throughout the specification refer to the same constituent elements.

FIG. 1 is a view illustrating a laundry treatment apparatus according to one embodiment of the present invention.

Hereinafter, the laundry treatment apparatus of the present invention will be described with reference to FIG. 1.

The laundry treatment apparatus 100 of the present invention may include a cabinet 1, a laundry accommodation unit 3, which is provided in the cabinet to accommodate laundry therein, a door 11, which is hingedly connected to the cabinet 1 in order to open or close the accommodation space 31, and a laundry support member for supporting laundry in the accommodation space 31.

The cabinet 1 may form the external appearance of the laundry treatment apparatus 100, and may be formed in the shape of a rectangular parallelepiped.

The laundry accommodation unit 3 may include an accommodation space 31, which is provided in the cabinet 1 to accommodate laundry therein.

The laundry support members may include at least one of a first laundry support member 310, which is provided in the accommodation space 31, a second laundry support member 312, which is provided at the door 11, and a third laundry support member 314, which is provided at an inner surface 31*a* of the accommodation space 31.

The first laundry support member 310 may take the form of a bar that extends in the width direction of the accommodation space 31 (i.e. in the width direction of the door 11 or in the Y-axis direction).

The second laundry support member 312 may be provided at the inner surface of the door 11 to allow laundry to be placed in the accommodation space 31 while being kept spread.

The third laundry support member 314 may be affixed to at least one of the rear surface, the left surface and the right surface, which constitute the inner surface 31*a* of the accommodation space 31, to allow laundry to be placed in the accommodation space 31 while being kept spread.

Figure 2:
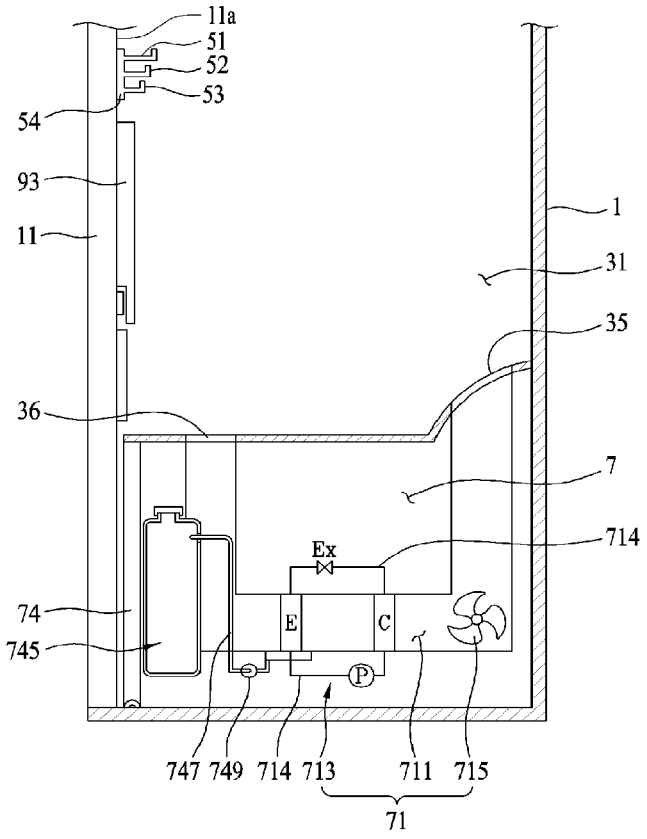
FIGS. 2 and 3 are sectional views of the laundry treatment apparatus according to the embodiment of the present invention.
Figure 3:
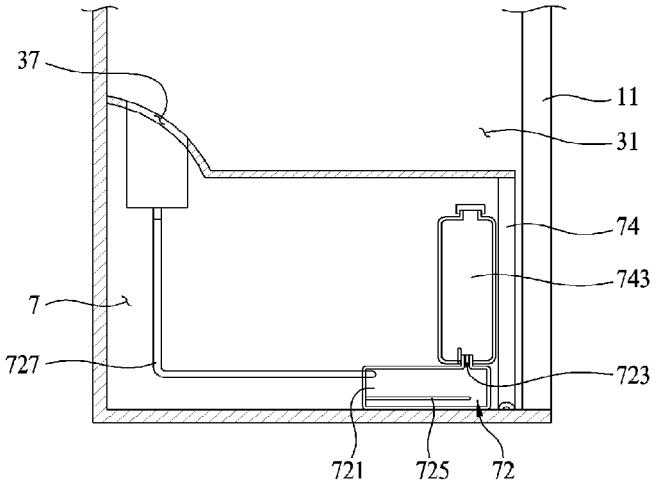

FIGS. 2 and 3 are sectional views of the laundry treatment apparatus according to the embodiment of the present invention.

Referring to FIG. 2, the second laundry support member 312 may include a base 54 affixed to the door 11 and one or more support pieces 51, 52 and 53 protruding from the base 54 and arranged in the height direction of the door 11 (i.e. in the Z-axis direction).

The laundry treatment apparatus 100 may include a machine room 7, which is provided in the cabinet 1 so as to be isolated from the accommodation space 31, and a supply unit, which is provided in the machine room 7 to supply at least one of air and moisture to the laundry accommodation unit.

The machine room 7 may be positioned below the accommodation space 31.

Air supplied to the accommodation space 31 by the supply unit may be heated air (or hot air), and moisture supplied to the accommodation space 31 by the supply unit may be steam.

The supply unit may include at least one of an air supply unit 71 for supplying air (heated air or unheated air) to the accommodation space 31 and a moisture supply unit for supplying moisture (steam or mist) to the accommodation space 31.

Hereinafter, for convenience of description, it is assumed that the supply unit includes both the air supply unit 71 and the moisture supply unit 72, the air supply unit 71 supplies hot air to the accommodation space 31, and the moisture supply unit 72 supplies steam to the accommodation space 31.

The air supply unit 71 may include a circulation duct 711 for circulation of internal air in the accommodation space 31, a heat exchanger 713 for heat exchange with air moving through the circulation duct 711, and a blower 715 for movement of internal air in the accommodation space 31 through the circulation duct 711.

The circulation duct 711 communicates with the interior of the accommodation space 31 through an air discharge port 35 and an air suction port 36, which are provided at the accommodation space 31, and internal air in the accommodation space sequentially circulates through the air suction port, the circulation duct, the air discharge port and the accommodation space.

The air discharge port 35 and the air suction port 36 are formed so as to penetrate the bottom of the accommodation space 31. The circulation duct 711 mounted in the machine room 7 is connected at one end thereof to the air suction port 36 and at the other end thereof to the air discharge port 35.

The heat exchanger 713 serves to dehumidify and heat air introduced into the circulation duct 711. The heat exchanger 713 may take the form of a heat pump; however, the heat exchanger in the laundry treatment apparatus of the present invention is not limited to a heat pump.

The heat exchanger 713 may include an evaporator E disposed in the circulation duct 711, a condenser C disposed in the circulation duct 711, a compressor P disposed outside the circulation duct 711, and an expansion device Ex disposed outside the circulation duct 711. The evaporator E, the compressor P, the condenser C, and the expansion device Ex are connected to one another via refrigerant tubes 714.

The compressor P serves to compress refrigerant to a high pressure to allow the refrigerant to be circulated through the refrigerant tubes 714. The evaporator E serves to evaporate the refrigerant by absorbing heat from air within the circulation duct 711. The condenser C serves to condense the refrigerant by discharging heat to the air within the circulation duct 711.

The blower 715 is located in the circulation duct 711 and serves to cause circulation of the internal air in the accommodation space 31 through the circulation duct 711. The blower 715 may be located between the condenser C and the air discharge port 35.

When the blower 715 is operated, the air within the circulation duct 711 moves to the accommodation space 31 through the air discharge port 35, and the air within the accommodation space 31 moves to the circulation duct 711 through the air suction port 36.

The air introduced into the circulation duct 711 through the air suction port 36 is cooled while passing through the evaporator E, and in turn, the air having passed through the evaporator E is heated while passing through the condenser C.

When the air is cooled while passing through the evaporator E, moisture contained in the air is removed (dehumidification), and the moisture removed from the air (condensed water) remains on the surface of the evaporator E or within the circulation duct 711.

The laundry treatment apparatus 100 may include a drain unit for removing condensed water generated by the evaporator E. The drain unit serves to prevent the heat exchange efficiency of the heat exchanger 713 from being deteriorated due to the condensed water remaining in the circulation duct 711.

The drain unit may include a drain tank 745, which is removably mounted to the machine room door 74, and a drain pipe 747 and a drain pump 749, which serve to supply the condensed water from the circulation duct 711 to the drain tank 745.

Meanwhile, as is exemplarily shown in FIG. 3, the moisture supply unit 72 may include a reservoir 721 disposed in the machine room 7, a heater 725 disposed in the reservoir 721, and a moisture supply pipe 727 connecting the reservoir 721 to a moisture discharge port 37.

The reservoir 721 serves to store water therein. The heater 725 serves to heat the water stored in the reservoir 721 to convert the water into steam. The moisture supply pipe 727 serves to guide steam from the reservoir 721 to the accommodation space 31.

The reservoir 721 receives water via a water supply unit. The water supply unit may include a water supply tank 743, which is removably mounted to the machine room door 74.

The reservoir 721 may be provided with a connection pipe 723, which is connected to the water supply tank 743 when the machine room door 74 closes the machine room 7 and which is separated from the water supply tank 743 when the machine room door 74 opens the machine room 7.

The reason why the water supply tank 743 is removably mounted to the machine room door 74 is that the laundry treatment apparatus 100 according to the present invention may be installed at a position distant from a water supply source (not shown).

The laundry treatment apparatus 100 according to the present invention is configured to supply hot air or steam while keeping laundry spread within the accommodation space 31, thereby preventing the laundry from being wrinkled after steam or hot air is completely supplied thereto.

Figure 4:
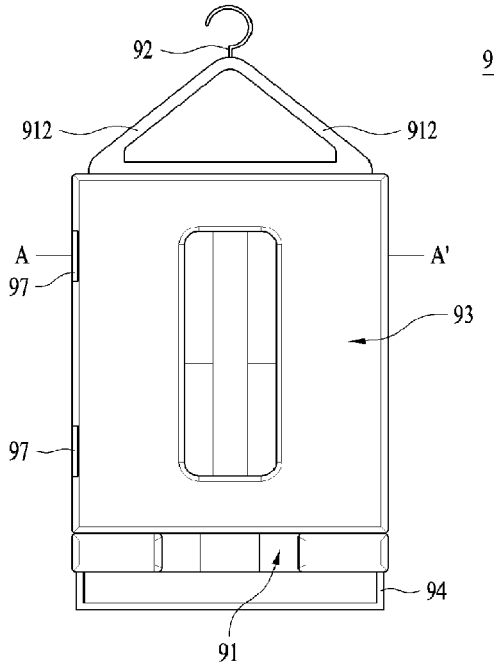
FIG. 4 is a front view of a presser provided at the laundry treatment apparatus according to the embodiment of the present invention.

FIG. 4 is a front view of the presser provided at the laundry treatment apparatus according to the embodiment of the present invention.

The presser of the laundry treatment apparatus according to the embodiment of the present invention will now be described with reference to FIG. 4.

The laundry treatment apparatus 100 may include a presser 9, which is provided in the laundry accommodation unit to remove wrinkles from laundry or form a crease in laundry (refer to FIG. 1).

The presser 9 may be configured to press laundry in order to remove wrinkles from laundry or sharpen a crease formed in laundry. The presser 9 may be removably mounted to the laundry support member.

Figure 5:
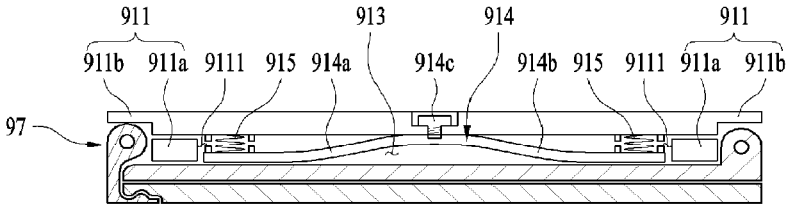
FIG. 5 is a sectional view of FIG. 4.
Figure 6:
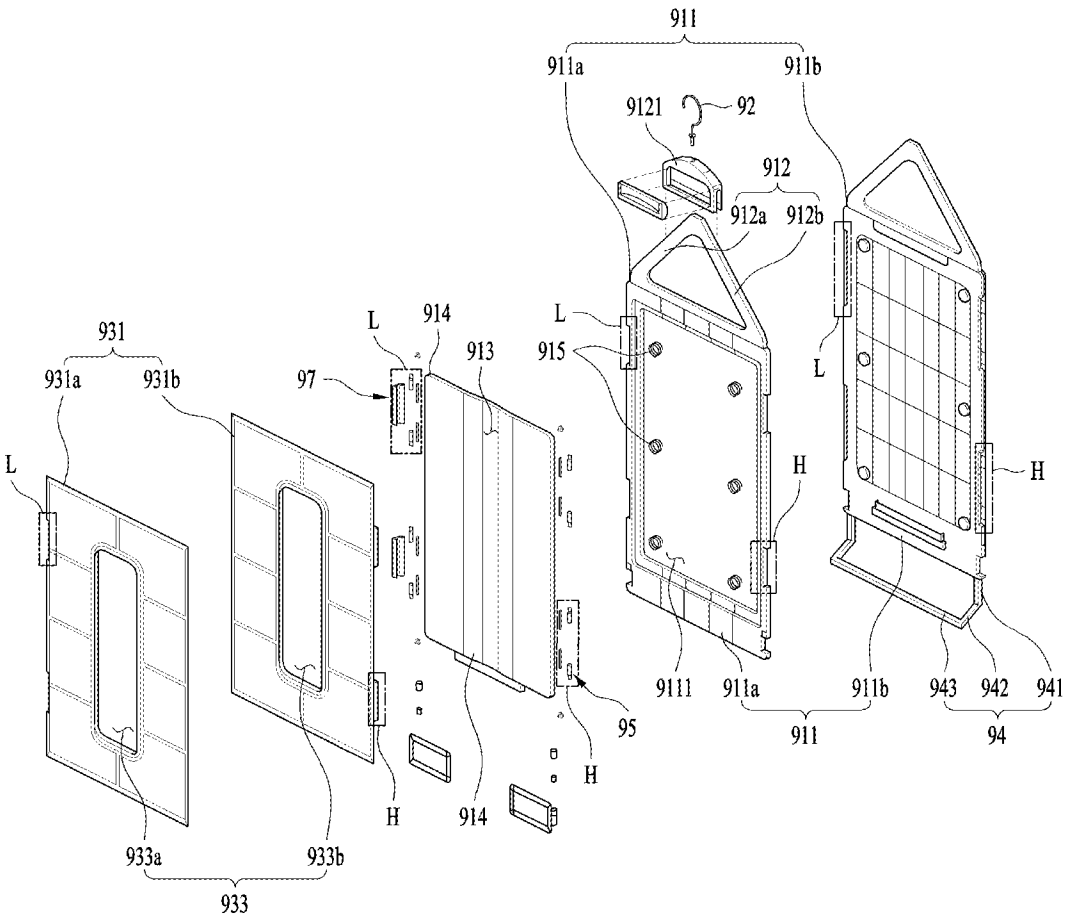
FIG. 6 is an exploded perspective view of one embodiment of the presser provided at the laundry treatment apparatus of the present invention.

FIG. 5 is a sectional view of FIG. 4. FIG. 6 is an exploded perspective view of one embodiment of the presser provided at the laundry treatment apparatus of the present invention.

The presser 9 may include a support part 91, which supports one surface of laundry, a hanger hook 92, which is hung on the laundry support member 310, 312 or 314, and a press part 93, which is hingedly connected to the support part 91 to apply pressure to the opposite surface of the laundry.

The hanger hook 92 may be provided at the upper end of the support part 91. The hanger hook takes the form of a hook that can be hung on at least one of the first to third laundry support members, and serves to support the loads of the presser and the laundry.

In addition, the hanger hook 92 may be provided at an extension portion 912, which is integrally formed at the support part 91 and extends upwards therefrom. The extension portion 912 may include a first extension portion 912*a* and a second extension portion 912*b*, which extend from both sides of the upper end of the support part in an inclined manner so as to meet each other. The hanger hook 92 may be provided at the portion at which the first extension portion and the second extension portion meet each other. However, the extension portion is not limited to the above configuration, and may be configured to extend from the middle of the upper end of the support part.

The laundry treatment apparatus according to the embodiment may include a laundry-fixing member 9121 for fixing laundry to the presser 9.

The laundry-fixing member 9121 may be provided at the portion of the extension portion 912 at which the first extension portion 912*a* and the second extension portion 912*b* meet each other, and may take the form of a clip. The laundry-fixing member 9121 may serve to support the lower end of trousers such that the upper end of the trousers is oriented downwards by gravity. The upper end of the trousers may be pressed between the support part and the press part so that wrinkles may be removed therefrom.

The laundry treatment apparatus according to the embodiment may include a separation frame 94, which is provided at the presser 9 in order to form a gap between the presser 9 and the inner surface of the accommodation space.

When the presser 9 is mounted in the accommodation space and hot air or steam is supplied to laundry, the steam condenses into water on the inner surface of the accommodation space or the inner surface of the door. If the presser 9 is in contact with the inner surface of the accommodation space, there may occur a problem in that laundry is wet by water. This problem is prevented by the separation frame 94, which separates the presser 9 from the inner surface of the accommodation space or the inner surface of the door.

The separation frame 94 may be provided at the lower end of the support part, may be configured to be movable upwards and downwards with respect to the support part, and may be formed to be bent forward or backward from the presser so that the presser is spaced a predetermined distance apart from the inner surface of the accommodation space. The separation frame 94 may include a first frame 941, which is configured to be movable upwards and downwards so as to be inserted into or withdrawn out of the support part, a second frame 942, which is bent at the distal end of the first frame at a predetermined angle in the forward or backward direction of the presser, and a third frame 943, which extends horizontally from the distal end of the second frame in the lateral direction (the width direction) of the separation frame.

The support part 91 may include a support body 911, which forms the external appearance of the support part, and a support plate 914, which is disposed in front of the support body 911 to support one surface of laundry.

The support body 911 may be formed in the shape of a rectangle using a plastic material.

The support body 911 may include a front support body 911*a* and a rear support body 911*b* coupled to the rear surface of the front support body 911*a*. The reason why the support body is constituted by the front support body and the rear support body is to enhance the strength thereof.

The support plate 914 may be secured to the front surface of the support body 911.

The support plate 914 may be securely seated in a support plate seat portion 9111, which is formed in the front surface of the support body 911. The support plate seat portion 9111 may be concavely formed in the front surface of the support body such that the inner periphery of the support plate seat portion 9111 is shaped so as to correspond to the outer periphery of the support plate 914.

The support plate seat portion 9111 may be a rectangular-shaped hole, which is formed through the front support body 911*a*. When the rear support body 911*b* is coupled to the rear surface of the front support body 911*a*, the rear support body 911*b* shields the rear open portion of the support plate seat portion formed through the front support body, and the front open portion of the support plate seat portion is maintained in the opened state.

The support plate 914 may be secured to the front surface of the rear support body 911*b* through the support plate seat portion, and the support plate is received in the support plate seat portion.

The support plate may be configured such that the middle portion in the lateral direction thereof is secured to the front surface of the support body 911 and such that the distance between the support plate and the support body 911 gradually increases from the middle portion of the support plate to both lateral sides thereof.

Both lateral sides of the support plate 914 may be located further forward than the middle portion thereof. The support plate 914 may be configured such that both lateral sides thereof continuously extend from the middle portion thereof in the forward diagonal direction.

In order to prevent a seam line created in the longitudinal direction of trousers from being pressed, the support plate 914 may include a support body recess 913, which is formed in the height direction of the presser. The support body recess 913 may be formed in the middle portion in the lateral direction of the support plate 914, and may extend in the height direction when seen from the front of the support plate 914.

The support plate 914 may be formed of an elastic material, for example, plastic. Therefore, when laundry is placed and pressed between the support part and the press part, the support plate applies pressure to both lateral sides of the laundry, excluding a seam line thereof.

The laundry treatment apparatus according to the embodiment may include a support spring 915, which is provided between the support plate 914 and the rear support body 911*b*.

The support spring 915 applies elastic force to the rear surface of the support plate 914 in the forward direction of the presser. Therefore, when laundry is pressed between the support part and the press part, the support plate may press the rear surface of the laundry.

Figure 7:
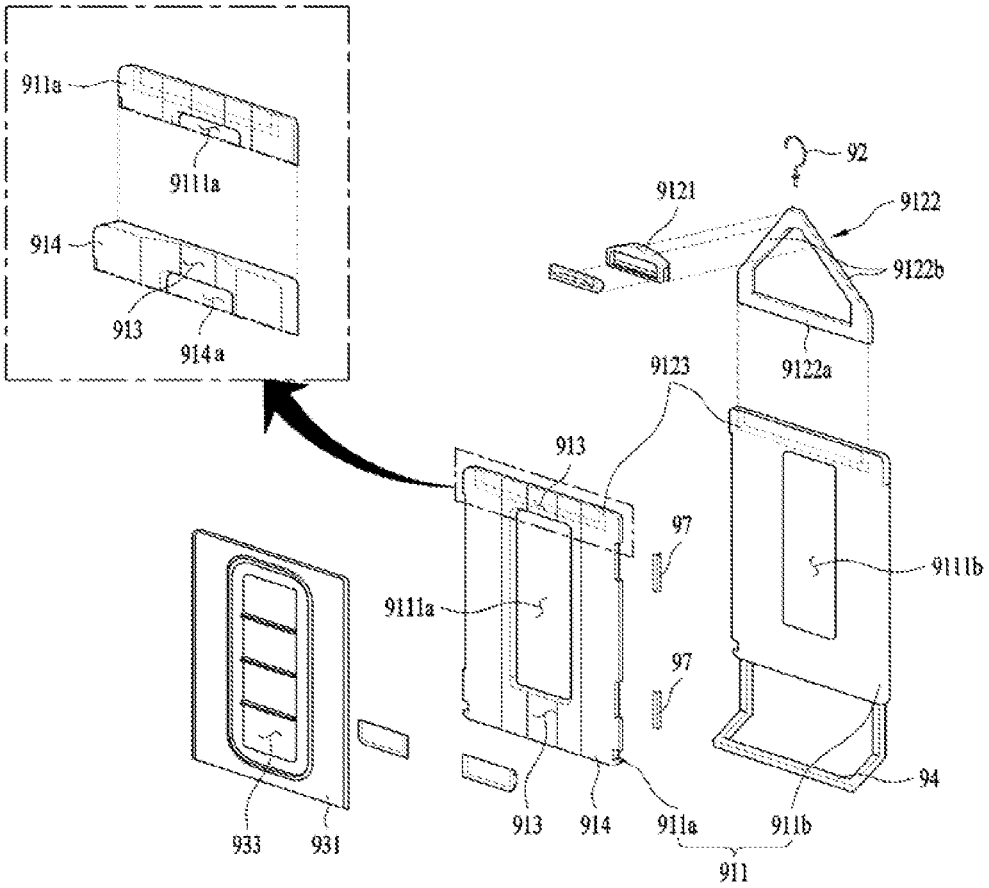
FIG. 7 is an exploded perspective view of another embodiment of the presser provided at the laundry treatment apparatus of the present invention.

FIG. 7 is an exploded perspective view of another embodiment of the presser provided at the laundry treatment apparatus of the present invention. Only differences between the presser of the laundry treatment apparatus according to this embodiment and the presser of the laundry treatment apparatus according to the previous embodiment will be described with reference to FIG. 7. Except for the differences set forth below, the configuration of the presser of the laundry treatment apparatus according to the previous embodiment may be applicable to the presser of the laundry treatment apparatus according to this embodiment.

The support part 91 may include a support body 911, a support plate 914 disposed in front of the support body 911, and a support part through-hole formed through the support body and the support plate.

The support part through-hole may include a support body through-hole 9111*a* and 9111*b* formed through the support body 911 and a support plate through-hole 914*a* formed through the support plate 914. The support body through-hole may include a front support body through-hole 9111*a* formed through the front support body 911*a* and a rear support body through-hole 9111*b* formed through the rear support body 911*b*.

Steam or hot air, which is supplied to the accommodation space, may be supplied to laundry through the support part through-hole formed through the support part 91, thereby effectively removing wrinkles from the laundry.

The presser of the laundry treatment apparatus according to this embodiment may include an extension frame 9122, which is provided separately from the support body 911, instead of the extension portion 912 as in the previous embodiment.

The extension frame 9122 may be formed of a metal material or a plastic material. The extension frame 9122 may include a first extension frame 9122*a*, which is fitted between the front support body 911*a* and the rear support body 911*b*, and a second extension frame 9122*b*, which extends upwards from the first extension frame 9122*a*.

There may be provided a hanger hook 92, which may be removably coupled to the second extension frame 9122*b*.

Hereinafter, the presser of the laundry treatment apparatus according to the embodiment will be described further with reference to FIGS. 5 and 6.

Referring to FIG. 6, the press part 93 may be hingedly connected to the support part 91 in order to press laundry placed between the press part 93 and the support part 91.

The press part 93 may include a press body 931, which has one side hingedly connected to one side of the support body 911 using a hinge structure 95 and the opposite side functioning as a free end and detachably attached to the opposite side of the support body 911, and a press body through-hole 933, which is formed through the press body 931.

The press body 931 may include a front press body 931*a* and a rear press body 931*b* coupled to the rear surface of the front press body 931*a*. The reason why the press body 931 is constituted by the front press body and the rear press body is to enhance the strength thereof.

Once laundry is supported by the surface of the support body 911 and the press body 931 is locked to the support body 911 by a locking structure 97, the laundry is pressed between the support body 911 and the press body 931, and hot air or steam supplied to the accommodation space 31 is supplied to the laundry through the press body through-hole 933. Accordingly, the laundry treatment apparatus of the present invention has effects of removing wrinkles from laundry and sharpening a crease formed in laundry.

The press body through-hole 933 may be a hole that is formed through the press body 931.

The press body through-hole may include a front press body through-hole 933*a* formed through the front press body 931*a* and a rear press body through-hole 933*b* formed through the rear press body 931*b*. The front press body through-hole 933*a* and the rear press body through-hole 933*b* may be formed so as to communicate with each other.

Figure 8:
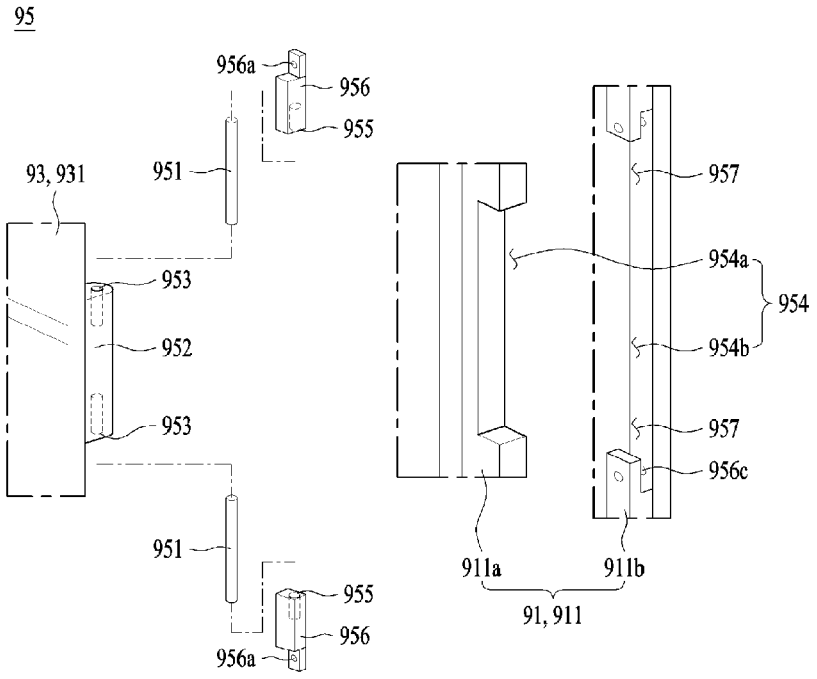
FIG. 8 is an enlarged exploded perspective view of a hinge structure, which is denoted by "H" in FIG. 6.
Figure 9A:
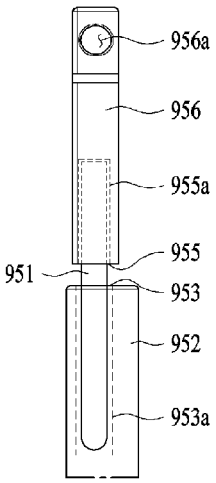
FIG. 9A is view showing the state in which both end portions of a hinge shaft are inserted into a hinge bracket and a hinge support portion.
Figure 9B:
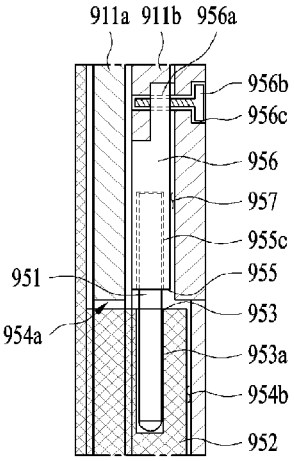
FIG. 9B is a view showing the state in which the hinge bracket is inserted and seated in a bracket seat portion.

FIG. 8 is an enlarged exploded perspective view of a hinge structure, which is denoted by "H" in FIG. 6. FIG. 9A is view showing the state in which both end portions of a hinge shaft are inserted into a hinge bracket and a hinge support portion. FIG. 9B is a view showing the state in which the hinge bracket is inserted and seated in a bracket seat portion.

Hereinafter, the hinge structure of the laundry treatment apparatus according to the embodiment will be described with reference to FIGS. 8 and 9.

The hinge structure 95 connects the support part 91 and the press part 93 such that the press part 93 is hingedly connected to the support part 91.

The hinge structure 95 may include a hinge shaft 951, which extends in the height direction of the presser 9, a hinge support portion 952, which protrudes a predetermined length from the press part 93, a first hinge hole 953, which is formed in the hinge support portion 952 and into which one end portion of the hinge shaft 951 is inserted, a hinge insertion portion 954, which is concavely formed with a predetermined length in the support part 91 so as to allow the hinge support portion 952 to be inserted thereinto, and a second hinge hole 955, which is formed in the hinge insertion portion 954 and into which the opposite end portion of the hinge shaft 951 is inserted.

The hinge shaft 951 is formed in a cylindrical shape and is inserted into the first hinge hole and the second hinge hole, thereby allowing the press part to rotate relative to the support part.

The hinge support portion 952 may be formed so as to protrude toward the support part from the left side or the right side of the press part, and may extend a predetermined length in the height direction of the presser.

The first hinge hole 953 may be formed in the upper end and/or the lower end of the hinge support portion 952. The hinge support portion 952 may have therein an empty space 953*a*, which communicates with the first hinge hole 953. The hinge shaft 951 may be inserted into the empty space 953*a* formed in the hinge support portion 952 through the first hinge hole 953.

The hinge insertion portion 954 may be concavely formed in the left side or the right side of the support part 91, and may extend a predetermined length in the height direction of the presser.

The hinge insertion portion 954 may include a front hinge insertion portion 954*a* formed in the front support body 911*a* and a rear hinge insertion portion 954*b* formed in the rear support body 911*b*. When the front support body and the rear support body are coupled to each other, the front hinge insertion portion and the rear hinge insertion portion communicate with each other, thereby forming the space of the hinge insertion portion 954.

The second hinge hole 955 may be formed in the inner surface of the hinge insertion portion 954. The second hinge hole 955 may be formed in the upper end and/or the lower end of the inner surface of the hinge insertion portion 954. The support part may have therein an empty space 955*a*, which communicates with the second hinge hole 955. The hinge shaft 951 may be inserted into the empty space 955*a* formed in the support part through the second hinge hole 955.

When the hinge support portion 952 of the press part is inserted into the hinge insertion portion 954, the second hinge hole 955 formed in the hinge insertion portion 954 and the first hinge hole 953 formed in the hinge support portion 952 are aligned with and communicate with each other. The hinge shaft 951 is inserted into the first hinge hole and the second hinge hole, whereby the press part is hingedly connected to the support part.

The laundry treatment apparatus may include a hinge bracket 956, in which the second hinge hole 955 is formed.

The hinge bracket 956 may be seated in a bracket seat portion 957 formed in the support part. The bracket seat portion 957 is a space formed in the support body 911 so as to allow the hinge bracket 956 to be inserted and seated therein. The bracket seat portion 957 may be formed by engagement of the front support body 911*a* and the rear support body 911*b*.

The hinge bracket 956 may take the form of a polygonal column. The reason for this is to prevent the hinge bracket inserted in the bracket seat portion from rotating freely.

The second hinge hole 955 may be formed in the surface of the hinge bracket 956 that is oriented toward the hinge support portion. When the hinge bracket 956 is seated in the bracket seat portion 957, the second hinge hole 955 is exposed to the hinge insertion portion 954.

In order to fix the hinge bracket 956 to the interior of the bracket seat portion, the hinge bracket 956 may have therein a bracket-fixing hole 956*a*.

In the state in which the hinge bracket 956 is seated in the bracket seat portion, a bracket through-hole 956*c*, which is formed through the support body, communicates with the bracket-fixing hole 956*a*, and a bracket-fixing member 956*b* is fastened to the support body through the bracket through-hole 956*c* and the bracket-fixing hole 956*a*, thereby preventing the hinge bracket 956 from being separated from the bracket seat portion.

The order in which the press part 93 is connected to the support part 91 by the hinge structure 95 is as follows. One end portion of the hinge shaft 951 is inserted into the first hinge hole 53 formed in the hinge support portion 952, and the opposite end portion of the hinge shaft 951 is inserted into the hinge bracket 956. The hinge bracket 956 is inserted into the bracket seat portion 957 formed in the support body, and the bracket-fixing member 956*b* is fastened to the support body through the bracket through-hole 956*c* and the bracket-fixing hole 956*a*. As a result, the hinge bracket 956 is securely seated in the bracket seat portion 957 without being separated therefrom.

Figure 10:
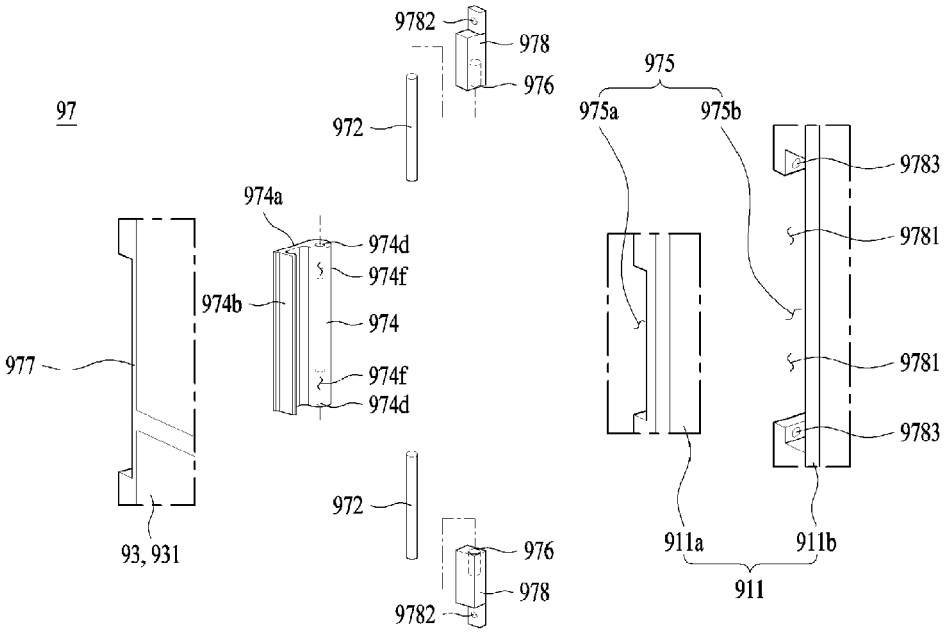
FIG. 10 is an enlarged exploded perspective view of a locking structure, which is denoted by "L" in FIG. 6.
Figure 11:
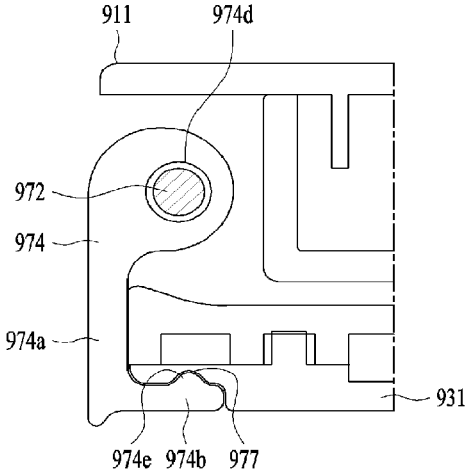
FIG. 11 is a sectional view of the locking structure.

FIG. 10 is an enlarged exploded perspective view of a locking structure, which is denoted by "L" in FIG. 6. FIG. 11 is a sectional view of the locking structure. Hereinafter, the locking structure of the laundry treatment apparatus according to the embodiment will be described with reference to FIGS. 10 and 11.

The locking structure 97 is configured to lock the free end of the press part 93 to the support part 91. The press part locked to the support part presses laundry in order to remove wrinkles from the laundry or sharpen a crease formed in the laundry.

The locking structure 97 may include a locking hinge shaft 972, which extends in the height direction of the presser 9, a locking body 974, which has therein a first locking hinge hole 974*d*, into which one end portion of the locking hinge shaft 972 is inserted, and which is configured to rotate relative to the support part 91, a locking extension portion 974*a*, which extends from the locking body 974 toward the press part 93 and which is configured to be locked to the press part 93, a locking insertion portion 975, which is concavely formed in the support part 91 so as to allow the locking body 974 to be inserted thereinto, and a second locking hinge hole 976, which is formed in the locking insertion portion 975 and into which the opposite end portion of the locking hinge shaft 972 is inserted.

The locking hinge shaft 972 is formed in a cylindrical shape and connects the support body 911 and the locking body 974. The locking body 974 is connected to the support body 911 such that the locking body 974 rotates relative to the support body 911.

The locking body 974 may be formed in a cylindrical shape and may have a first locking hinge hole 974*d* formed in each of both ends thereof. The locking body 974 may have therein an empty space 974*f*, which communicates with the first locking hinge hole 974*d*. The locking hinge shaft 972 may be inserted into the empty space 974*f* communicating with the first locking hinge hole 974*d*.

The locking structure 97 may include a first locking protrusion 974*b*, which extends from the distal end of the locking extension portion 974*a*. The first locking protrusion 974*b* may extend perpendicular to the locking extension portion 974*a* so as to be brought into contact with the front surface of the press body 931. Therefore, the first locking protrusion 974*b* pressurizes the front surface of the press body 931, thereby preventing the press body 931 from rotating away from the support body 911.

The first locking protrusion 974*b* may have a second locking protrusion 974*e*, which protrudes toward the front surface of the press body 931 from the portion of the first locking protrusion 974*b* that contacts the front surface of the press body 931. The press body 931 has a locking recess 977 formed in the front surface thereof, into which the second locking protrusion 974*e* is selectively fitted. When the free end of the press part completely rotates to the support part, the second locking protrusion 974*e* is fitted into the locking recess 977 formed in the front surface of the press body, thereby preventing rotation of the press body.

The locking insertion portion 975 is concavely formed in one side of the support body, and the locking body 974 is rotatably inserted into the locking insertion portion 975.

The locking insertion portion 975 may include a front locking insertion portion 975*a* formed in the front support body 911*a* and a rear locking insertion portion 975*b* formed in the rear support body 911*b*. When the front support body and the rear support body are coupled to each other, the front locking insertion portion and the rear locking insertion portion communicate with each other, thereby forming the space of the locking insertion portion 975.

The second locking hinge hole 976 may be formed in the upper end and/or the lower end of the inner surface of the locking insertion portion 975. The second locking hinge hole 976 communicates with an empty space formed in the support body. The opposite end portion of the locking hinge shaft 972 may be inserted into the empty space formed in the support body through the second locking hinge hole.

When the locking body 974 is inserted into the locking insertion portion 975, the first locking hinge hole 974*d* and the second locking hinge hole 976 are aligned with and communicate with each other. The locking hinge shaft 972 may be inserted into the first locking hinge hole and the second locking hinge hole.

Meanwhile, the second locking hinge hole 976 may be formed in a locking bracket 978, which is an additional element, rather than in the support body. The locking bracket 978 may be provided separately from the support body. The reason for this is to simplify the structure of the support body, thereby simplifying the manufacturing process and reducing manufacturing costs.

Referring to FIGS. 9A and 9B, the hinge support portion 952 may correspond to the locking body 974, the bracket 956 may correspond to the locking bracket 978, and the hinge shaft 951 may correspond to the locking hinge shaft 972. Therefore, the explanation of the bracket 956 in the hinge structure may be applicable to the locking bracket 978 in the locking structure.

The locking bracket 978 may be seated in a locking bracket seat portion 9781 formed in the support body. The locking bracket seat portion 9781 is a recess formed in one side of the support body, which may be formed by engagement of the front support body 911*a* and the rear support body 911*b*.

The locking bracket 978 may take the form of a polygonal column, preferably a rectangular column. The inner periphery of the locking bracket seat portion 9781 is shaped so as to correspond to the outer periphery of the locking bracket 978, thereby preventing the locking bracket 978 inserted in the locking bracket seat portion 9781 from undesirably rotating.

In order to fix the locking bracket 978 to the locking bracket seat portion 9781, the locking bracket 978 may have therein a locking-bracket-fixing hole 9782. The locking-bracket-fixing hole 9782 may communicate with a locking-bracket through-hole 9783 formed through the support body. A fixing member may be fastened to the support body through the locking-bracket-fixing hole 9782 and the locking-bracket through-hole 9783, thereby securing the locking bracket 978 to the locking bracket seat portion 9781 so that the locking bracket 978 is prevented from escaping from the locking bracket seat portion 9781.

As is apparent from the above description, the present invention provides a laundry treatment apparatus capable of performing washing, drying, deodorization, sterilization and wrinkle removal of laundry.

In addition, the laundry treatment apparatus according to the present invention removes wrinkles from laundry and applies pressure to laundry so as to sharpen a crease formed in the laundry.

In addition, the laundry treatment apparatus according to the present invention provides a presser that is removably mounted thereto so that the position of the presser may be moved.

In addition, the laundry treatment apparatus according to the present invention provides a presser that is greatly reduced in thickness so that the position of the presser may be efficiently moved in the inner space in the laundry treatment apparatus.

In addition, the laundry treatment apparatus according to the present invention includes a presser that is removably mounted to a laundry support member.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A laundry treatment apparatus comprising:
- a cabinet including an accommodation space to accommodate laundry;
- a laundry support member provided in the accommodation space; and
- a presser removably mounted to the laundry support member and configured to apply pressure to laundry to remove wrinkles, wherein the presser includes:
- a support part to support one surface of the laundry;
- a hanger hook provided at an upper end of the support part and configured to be hung on the laundry support member; and
- a press part hingedly connected to the support part and configured to apply pressure to an opposite surface of laundry;

wherein the support part includes:
- a support body forming the external appearance of the support part;
- a support plate disposed in front of the support body to support one surface of the laundry; and
- a support spring provided between the support body and the support plate to apply elastic force to the support plate.

2. The laundry treatment apparatus of claim 1, wherein the support plate is formed such that both lateral sides thereof are located further forward than the middle portion thereof and the middle portion in the lateral direction thereof is secured to the support body.

3. The laundry treatment apparatus of claim 1, wherein the support spring is located between the both sides of the support plate and the support body in the lateral direction.

4. The laundry treatment apparatus of claim 1, wherein the hanger hook is provided at an extension portion, integrally formed with the support part, and extends upwards from the support part.

5. The laundry treatment apparatus of claim 1, further comprising:
- a laundry-fixing member configured to fix the laundry to the presser.

6. The laundry treatment apparatus of claim 1, further comprising:
- a separation forming a gap between the presser and an inner surface of the accommodation space.

7. The laundry treatment apparatus of claim 1, further comprising:
- a hinge structure connecting the support part and the press part, wherein the hinge structure includes:
- a hinge shaft extending in a height direction of the presser;
- a hinge support portion protruding from the press part;
- a first hinge hole formed in the hinge support portion to receive one end portion of the hinge shaft inserted thereinto;
- a hinge insertion portion formed in the support part to receive the hinge support portion inserted thereinto; and
- a second hinge hole formed in the hinge insertion portion to receive an opposite end portion of the hinge shaft inserted thereinto.

8. The laundry treatment apparatus of claim 7, wherein the hinge insertion portion is concavely shaped.

9. The laundry treatment apparatus of claim 7, wherein the hinge support portion protrudes from the press part by a predetermined length.

10. The laundry treatment apparatus of claim 7, wherein the hinge insertion portion formed in the support part has a predetermined length.

11. The laundry treatment apparatus of claim 7, wherein the hinge structure further includes:
- a hinge bracket having therein the second hinge hole; and
- a bracket seat portion formed in the support part to allow the hinge bracket to be seated therein.

12. The laundry treatment apparatus of claim 11, wherein the hinge bracket includes a bracket-fixing hole,
- wherein the bracket-fixing hole communicates with a bracket through-hole formed in the support part, and
- wherein a bracket-fixing member is fastened to the support part through the bracket through-hole and the bracket-fixing hole so that the hinge bracket is secured to the bracket seat portion.

13. The laundry treatment apparatus of claim 1, further comprising:

a locking structure to lock a free end of the press part to the support part, wherein the locking structure includes:

a locking hinge shaft extending in a height direction of the presser;

a locking body having therein a first locking hinge hole to receive one end portion of the locking hinge shaft inserted thereinto, the locking body rotateable relative to the support part;

a locking extension portion extending from the locking body toward the press part and configured to be locked to the press part;

a locking insertion portion formed in the support part to receive the locking body inserted thereinto; and a second locking hinge hole formed in the locking insertion portion to receive an opposite end portion of the locking hinge shaft inserted thereinto.

14. The laundry treatment apparatus of claim 13, wherein the locking insertion portion is concavely shaped.

15. The laundry treatment apparatus of claim 13, wherein the locking structure further includes:

a locking bracket including the second locking hinge hole; and a locking bracket seat portion formed in the support part to allow the locking bracket to be seated therein.

16. The laundry treatment apparatus of claim 15, wherein the locking bracket includes a locking-bracket-fixing hole, wherein the locking-bracket-fixing hole communicates with a locking-bracket through-hole formed in the support part, and wherein a fixing member is fastened to the support part through the locking-bracket-fixing hole and the locking-bracket through-hole so that the locking bracket is secured to the locking bracket seat portion.

17. The laundry treatment apparatus of claim 13, wherein the locking extension portion includes a first locking protrusion and a second locking protrusion protruding toward the press part and is configured to be fitted into a locking recess formed in the press part.

* * * * *